US005931989A

United States Patent [19]

Knutsson

[11] Patent Number: 5,931,989

[45] Date of Patent: Aug. 3, 1999

[54] DEVICE IN AN ELECTROSTATIC PRECIPITATOR FOR THE SUSPENDING, CONTROLLING AND RAPPING OF COLLECTING ELECTRODES

[75] Inventor: Filip Knutsson, Växjö, Sweden

[73] Assignee: ABB Fläkt AB, Stockholm, Sweden

[21] Appl. No.: 08/930,066

[22] PCT Filed: May 10, 1996

[86] PCT No.: PCT/SE96/00611

§ 371 Date: Nov. 25, 1997

§ 102(e) Date: Nov. 25, 1997

[87] PCT Pub. No.: WO97/00727

PCT Pub. Date: Jan. 9, 1997

[30] Foreign Application Priority Data

Jun. 20, 1995 [SE] Sweden ..... 9502246

[51] Int. Cl.[6] ..... B03C 3/76

[52] U.S. Cl. ..... 96/33; 96/38

[58] Field of Search ..... 96/32–38, 92, 96/93

[56] References Cited

U.S. PATENT DOCUMENTS

| | | | |
|---|---|---|---|
| 2,893,511 | 7/1959 | Egan | 96/34 |
| 3,158,453 | 11/1964 | Maartman et al. | 96/34 |
| 3,165,388 | 1/1965 | Jaderbrandt | 96/34 |
| 3,427,787 | 2/1969 | Hilge | 96/34 |
| 3,920,085 | 11/1975 | Bourke | 96/35 X |
| 4,221,573 | 9/1980 | Hankins | 96/35 |
| 5,366,540 | 11/1994 | Bojsen | 96/33 |
| 5,554,210 | 9/1996 | Anderson | 96/93 X |

FOREIGN PATENT DOCUMENTS

| | | |
|---|---|---|
| 64898 | 10/1946 | Denmark . |
| 0584880 A1 | 3/1994 | European Pat. Off. . |
| 0662347 A1 | 7/1995 | European Pat. Off. . |
| 1632459 A1 | 12/1970 | Germany . |

*Primary Examiner*—Richard L. Chiesa
*Attorney, Agent, or Firm*—Burns, Doane, Swecker & Mathis, L.L.P.

[57] ABSTRACT

A device in an electrostatic precipitator for suspending, controlling and rapping one or more collecting electrodes arranged essentially vertically in one or more substantially parallel rows includes, for each row, a substantially horizontally oriented carrier element, to which the upper ends of the collecting electrodes are attached, connecting elements which connect the carrier element to the casing of the electrostatic precipitator, a control arrangement for controlling the motion of each row of collecting electrodes in the transverse and/or longitudinal direction of the electrostatic precipitator, and a rapping mechanism for rapping the collecting electrodes of each row. The rapping mechanism includes a rapping device, such as a rapping hammer, and an anvil connected to the carrier element. The carrier element of each row is separately suspended by means of the connecting elements, thereby permitting, during rapping, a minimum horizontal pivoting motion restricted to each row of collecting electrodes and occurring in the longitudinal direction of the electrostatic precipitator.

21 Claims, 2 Drawing Sheets

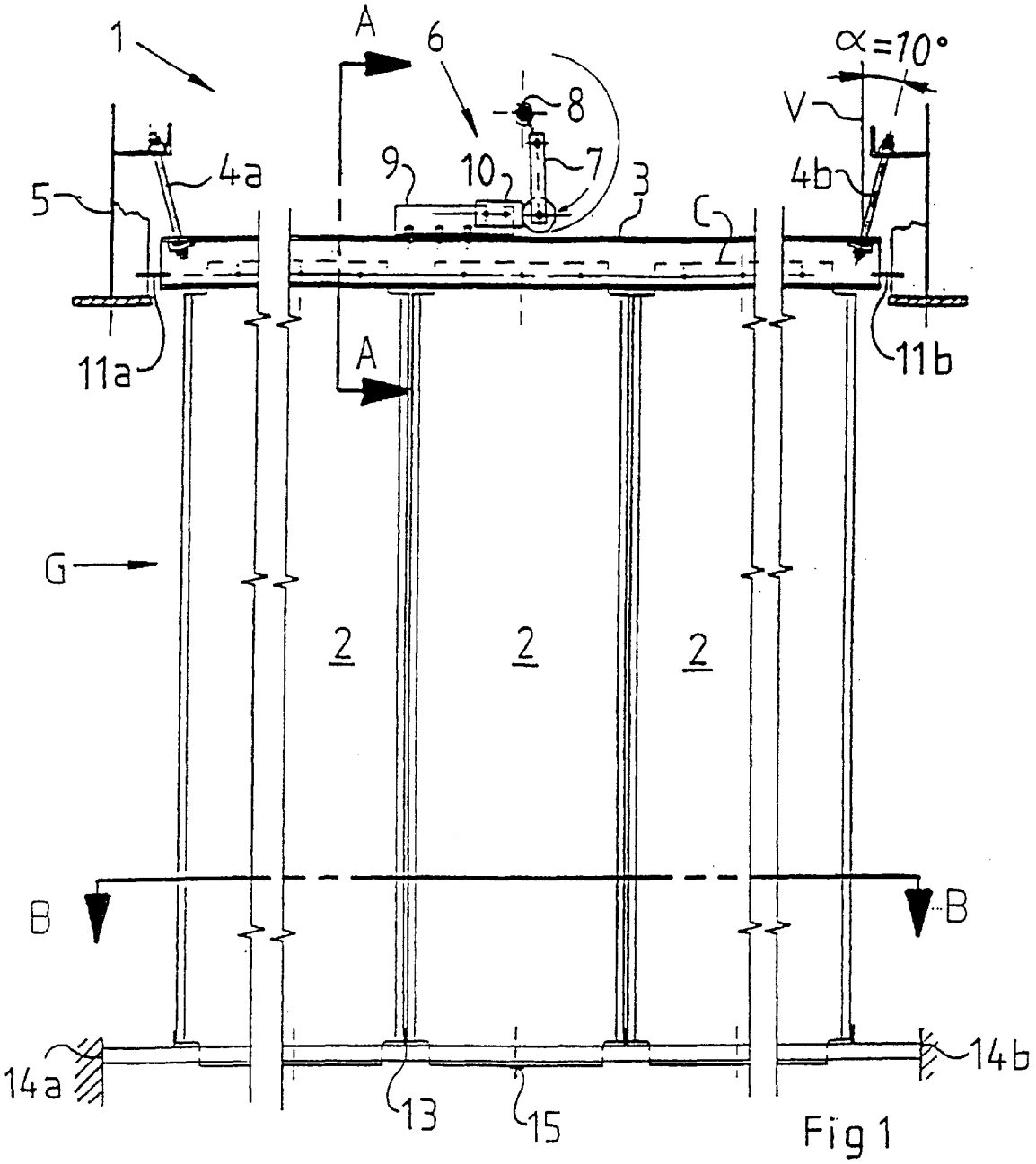
Fig 1
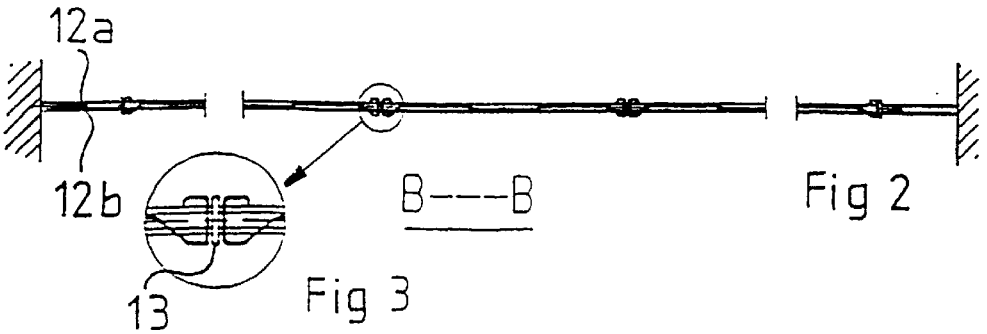
Fig 2
Fig 3

DEVICE IN AN ELECTROSTATIC PRECIPITATOR FOR THE SUSPENDING, CONTROLLING AND RAPPING OF COLLECTING ELECTRODES

BACKGROUND AND SUMMARY

The present invention relates to a device in an electrostatic precipitator for the suspending, controlling and rapping of one or more collecting electrodes arranged essentially vertically in one or more substantially parallel rows and comprising for each row a substantially horizontally oriented carrier element to which the upper ends of the collecting electrodes are attached, connecting elements which connect the carrier element to the casing of the electrostatic precipitator, control means for controlling the motion of each row of collecting electrodes in the transverse and/or longitudinal direction of the electrostatic precipitator, and a rapping mechanism for rapping the collecting electrodes of each row and comprising a rapping means, such as a rapping hammer, and an anvil connected to the carrier element.

Electrostatic precipitators are usually composed of a plurality of successive precipitation fields through which dust-laden gas is passed to be cleaned. Each of the precipitation fields is divided into a plurality of parallel gas passages by means of a plurality of juxtaposed, earthed collecting electrodes vertically arranged in rows . These are usually in the form of rectangular, substantially plate-shaped, sectional metal sheets. Vertical discharge electrodes, to which a negative voltage is supplied, are arranged in each gas passage. Owing to corona discharges at the discharge electrodes, the dust-laden gas is ionised in the electric field in the gas passages. The negative ions are attracted by the collecting electrodes and, while moving towards these, collide with the dust particles of the gas, which are then charged and separated from the gas by being attracted by the closest collecting electrode, on which they are deposited and build up a dust layer. At regular intervals, the dust layer is loosened, by vibrations, from the collecting electrodes by these being mechanically affected by means of a rapping mechanism. The dust particles then fall into a collecting hopper associated with the respective precipitation fields.

The rapping mechanism can either be arranged at the top or at the bottom of each row of collecting electrodes and usually comprises a rapping hammer acting in a vertical plane about a rotary shaft which extends horizontally in the transverse direction of the electrostatic precipitator and to which the rapping hammer thus is connected, and an anvil. The rapping force for cleaning each row of collecting electrodes is generated by the rapping hammer giving a horizontally directed rap via the anvil to a rapping means cooperating with the collecting electrodes, whereby a horizontal motion is imparted to the rapping means. This motion is transferred to the collecting electrodes in the form of a shock wave which spreads across these. Thus, the dust layer accumulated on the collecting electrodes is loosened.

A greater or smaller amount of the rapping force is absorbed by the suspension of the collecting electrodes during the cleaning operation. The amount of absorbed rapping force depends on the manner of connecting the collecting electrodes to the suspension and on the manner in which the suspension is connected to the casing of the electrostatic precipitator.

The collecting electrodes are usually controlled in the longitudinal as well as in the transverse direction of the electrostatic precipitator so as to be kept in exact positions and, thus, prevent flashovers.

There have been suggested various solutions of a device in an electrostatic precipitator for the suspending, controlling and rapping of its collecting electrodes.

For instance, EP 0 584 880 discloses a device for cleaning collecting electrodes in an electrostatic precipitator by rapping, the collecting electrodes being vertically arranged, successively in parallel rows. The collecting electrodes of each rows are, at their upper ends, attached between a pair of horizontally arranged longitudinal rapping beams and suspended from these, said beams thus also serving as carrier elements for the collecting electrodes. The rapping beams rest freely on a pair of supporting beams, between which the upper ends of the collecting electrodes are arranged. The pair of supporting beams rests, in turn, on a frame pertaining to the casing of the electrostatic precipitator. The pair of rapping beams thus is arranged so as to be able to slide, during rapping, horizontally on the supporting beams in the longitudinal direction of the electrostatic precipitator. During cleaning by rapping, the rapping force is transferred in the form of a shock wave by means of a rapping hammer to all the collecting electrodes of a row via an anvil, which is fixedly mounted on the pair of rapping beams of each row. On each side of the ends of the pair of rapping beams, laminated springs are mounted in the casing and cooperate with transverse so-called stop pins arranged at each end of the pair of rapping beams. A spring-back motion of the pair of rapping beams to its original position is permitted in connection with the rapping before the anvil is again hit by the rapping hammer. As a result, the laminated springs control the row of collecting electrodes in the longitudinal direction of the electrostatic precipitator. The laminated springs also serve as control means in the transverse direction of the electrostatic precipitator. A drawback of the thus disclosed device is that a relatively great amount of the rapping force is absorbed by the casing during rapping and, thus, is lost. Besides, for each row of collecting electrodes, the device consists of a large number of components, which makes it mechanically complicated.

The mounting of the respective rows is carried out in such a manner that the upper ends of the collecting electrodes are first inserted between the pair of the supporting beams and are temporarily mounted therein by means of bolts. Each rapping beam is then arranged on both sides of the upwardly extending ends of the collecting electrodes and is mounted therein by means of bolts, whereupon the bolts in the pair of supporting beams are removed. The mounting procedure accomplished in this manner thus is complicated and time-consuming. The mounting of each row will probably also take place inside the electrostatic precipitator, which is a drawback compared with the technique of mounting the row outside the electrostatic precipitator so as to be inserted afterwards.

One object of the present invention thus is, in view of that stated above, to provide a new and improved device in an electrostatic precipitator for suspending, controlling and rapping its collecting electrodes, said device allowing a more efficient use of the generated rapping force when cleaning the collecting electrodes. A further object of the present invention is to provide a device for suspending, controlling and rapping, which is mechanically simpler and, consequently, easier to mount.

These objects are achieved by a device which is of the type stated by way of introduction and which according to the present invention is characterised in that the carrier element of each row is suspended separately by means of connecting elements, which as stated above connect the carrier element to the casing of the electrostatic precipitator, thereby permitting a minimum horizontal pivoting motion restricted to each collecting electrode row and occurring in the longitudinal direction of the electrostatic precipitator. The pivoting motion arising in rapping occurs owing to the separate suspension and thus fully independently of the remaining rows. By a restricted, minimum pivot motion is meant a pivoting motion which is less than about 5 mm of the carrier element in its longitudinal direction.

According to the present invention, the connecting elements of the carrier element preferably comprise two elongate rods, each making an angle $\alpha$, relative to a vertical axis extending through each rod, in the range of about 5–35°, especially in the range of about 5–15°, in such a manner that said rods are positioned substantially in the plane of the row such that the distance between their lower ends is smaller than between their upper ends. In consequence of the carrier element being separately suspended in the above-mentioned fashion, the row of collecting electrodes will be self-centred after rapping, i.e. the row will immediately return to its correct original position.

The smaller the angle a the more movable the actual suspension, which means that a greater amount of the rapping force, relatively seen, will be absorbed by the casing, which results in poorer cleaning. On the other hand, the greater the angle $\alpha$, the more unresilient the suspension, which also results in poorer cleaning. To achieve optimum cleaning, i.e. to transfer as great an amount as possible of the rapping force to the collecting electrodes, the angle is adjusted according to the present invention so that as small an amount as possible of the rapping force is absorbed by the casing. Moreover, the angle $\alpha$ should be adjusted so as to prevent too great a pivoting motion of the collecting electrodes. By such suspension, which is mechanically simple and easy to mount, a more efficient cleaning of the collecting electrodes is provided.

According to the present invention, the control means of the device consist of upper control elements cooperating with the carrier element, and/or lower control elements cooperating with the lower ends of the collecting electrodes. The upper control elements preferably consist of upper cam control elements cooperating with the end portions of the carrier element. Advantageously, the cam control elements extend substantially horizontally in the transverse direction of the electrostatic precipitator through a plurality of rows and thus prevent each row of collecting electrodes from moving in said direction. The upper control elements also serve as control means in the longitudinal direction of the electrostatic precipitator, especially in case of small angles $\alpha$. By means of these upper control elements, which are mechanically simple and easy to mount, efficient control is achieved.

To further improve the control, in addition to the control provided by means of the upper control elements, lower control elements are preferably arranged at the bottom of each row and cooperate, as stated above, with the lower ends of the collecting electrodes.

According to a preferred embodiment of the inventive device, the lower ends of the collecting electrodes are loosely controlled by the lower control elements on the one hand in the transverse direction of the electrostatic precipitator by means of a longitudinally oriented, horizontal pair of rods, between which the lower ends of the collecting electrodes are arranged and, on the other hand, in the longitudinal direction of the electrostatic precipitator by means of spacer members arranged before, after and/or between the collecting electrodes.

A further alternative preferred embodiment of the inventive device is characterised in that the lower ends of the collecting electrodes are firmly controlled by the lower control elements in the transverse as well as longitudinal direction of the electric precipitator by means of longitudinally oriented, horizontal rods, to which the lower ends of the collecting electrodes are attached, preferably by means of bolts or rivets.

A common feature of the lower control is that each row of collecting electrodes is controlled in the transverse direction of the electrostatic precipitator by means of transversely oriented lower cam control elements arranged at the ends of said rods. The cam control elements advantageously extend substantially vertically in the transverse direction of the electrostatic precipitator through a number of rows and thus prevent the respective rows of collecting electrodes from moving in said direction. By means of these lower control elements, which are mechanically simple and easy to mount, efficient control is achieved. The lower and the upper control according to the invention is further designed with regard to thermal expansion.

According to the present invention, the anvil of the rapping mechanism is preferably directly fixedly mounted on the upper side of the carrier element and comprises a rapping shoulder, which is the rapping point of the rapping means, which is arranged in such a manner that the rapping point is located above the horizontal centre line of the carrier element. According to an alternative embodiment, the anvil can also extend across at least two rows of collecting electrodes in the transverse direction of the electrostatic precipitator. In this case, the anvil, which consists of e.g. a flat iron bar, is also directly fixedly mounted on the upper side of the carrier element of each row.

The rapping means of the rapping mechanism preferably acts in a vertical plane about a rotary shaft connected thereto and extending horizontally in the transverse direction of the electric precipitator, the rapping means giving the anvil a horizontally directed rap during rapping. In dependence on the embodiment, the rap is given to the anvil either directly or indirectly via the above-mentioned rapping shoulder.

A general advantage of the inventive device is that each row of collecting electrodes can be mounted outside the electrostatic precipitator and then be inserted.

BRIEF DESCRIPTION OF THE DRAWINGS

The invention will now be described in more detail with reference to the accompanying drawings, in which:

FIG. 1 is a schematic vertical section of a device according to the invention in parallel with a row of collecting electrodes in an electrostatic precipitator.

FIG. 2 is a horizontal section towards the collecting electrodes taken along line B—B in FIG. 1.

FIG. 3 is an enlarged view of a lower control element in FIG. 2.

DETAILED DESCRIPTION

Figure 4:
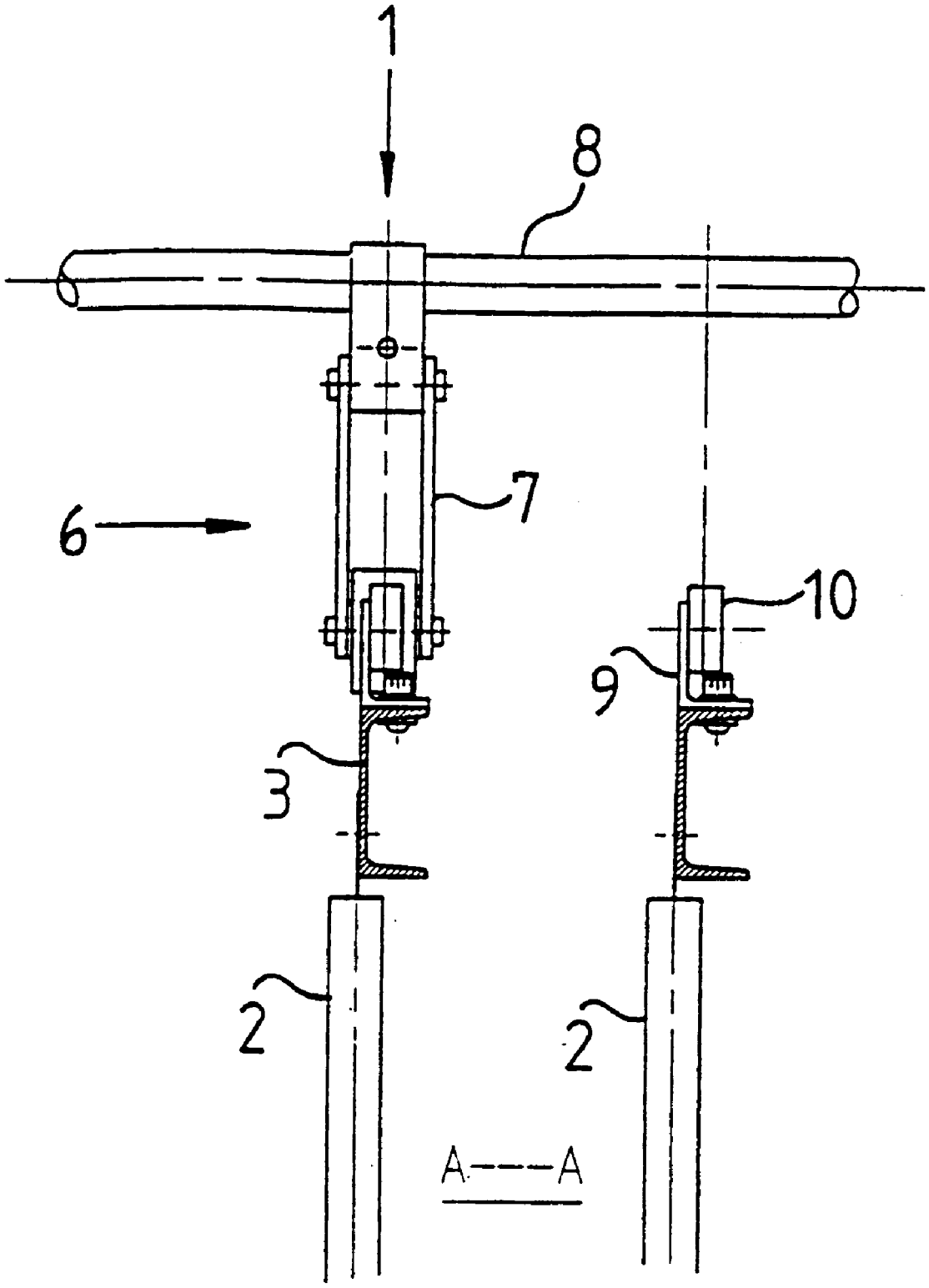
FIG. 4 is a vertical section towards the collecting electrodes taken along line A—A in FIG. 1.

FIG. 1 thus is a schematic vertical section in parallel with a row 1 of collecting electrodes 2 in an electrostatic precipitator, which for each row 1 is provided with a device for suspending, controlling and rapping the collecting electrodes 2.

The electrostatic precipitator comprises a plurality of successive precipitation fields, each field consisting of a plurality of parallel rows 1 of earthed collecting electrodes 2, which are vertically arranged in succession in the respective rows. Each row 1 of collecting electrodes consists of substantially plate-shaped, sectional metal sheets, which between themselves thus form gas passages for the dust-laden gas to be cleaned. The gas flow in the electrostatic precipitator occurs horizontally as indicated by arrow G. Between each row 1 of collecting electrodes 2, discharge electrodes (not shown) are accommodated, which are connected to a negative voltage.

As indicated in FIG. 1, the collecting electrodes 2 of each row are at their upper ends attached by means of rivets or bolts to a horizontally oriented, flexurally rigid carrier element in the form of a U-beam 3. The U-beam 3 is in turn separately and movably suspended by means of connecting elements, which in the embodiment illustrated consist of two inclined, elongate round bars 4*a,* 4*b*. The round bars 4*a,* 4*b* are positioned in the plane of the row and are oriented in such a manner that their lower ends face each other and make an angle α of about 10° relative to a vertical axis V extending through the respective round bars. The lower ends of the round bars 4*a,* 4*b* are secured to the end portions of the U-beam 3 in the upper flange thereof, and the upper ends of the round bars are secured to the casing 5. Because of this, according to the invention, special suspension of the U-beam 3 and the fact that the collecting electrodes 2 are in direct contact with the U-beam 3, a very small amount of the rapping force is absorbed by the casing 5, which results in efficient cleaning. Besides, the horizontal pivoting motion of the row 1 of collecting electrodes arising during cleaning will be minimal.

In the illustrated embodiment, the rapping mechanism 6 for cleaning the collecting electrodes 2 of each row is arranged in the centre of the U-beam 3 and comprises a rapping hammer 7, which acts in a vertical plane about a rotary shaft 8 extending horizontally in the transverse direction of the electrostatic precipitator, and an anvil 9. As shown in FIG. 1, the anvil 9 in the form of an L-beam is directly fixedly mounted by means of bolts on the upper side of the U-beam 3 and comprises a rapping shoulder 10. The U-beam 3 thus serves as carrier element as well as rapping means for the collecting electrodes 2. During cleaning, the U-beam 3 is subjected to a horizontally directed motion by the rapping hammer 7 giving the rapping shoulder 10 arranged on the anvil 9 a rap, which is transferred in the form of a shock wave to the collecting electrodes 2 via the carrier beam 3. The rapping point of the rapping hammer 7 thus is placed in such a manner that it is located above the horizontal centre line C of the U-beam 3, which is also evident from FIG. 4. The shock wave spreads downwards along all the collecting electrodes 2 of the row 1, which are thus caused to vibrate, whereupon the dust layer is loosened by the vibrations. The dust particles then fall into a collecting hopper (not shown) pertaining to the respective precipitation fields.

The illustrated device further comprises control means which consist of upper and lower control elements for controlling the motion of each row 1 of collecting electrodes in the transverse as well as longitudinal direction of the electrostatic precipitator. In order to prevent, during the cleaning operation, flashover because of the motion of the row 1 in the transverse direction of the electrostatic precipitator, the U-beam 3 is provided with upper control elements in the form of upper cam control elements 11*a,* 11*b,* which at each end of the U-beam 3 cooperate with the web thereof. The upper cam control elements 11*a,* 11*b* also constitute a certain control of the carrier element 3 of the row, and thus the row, in the longitudinal direction of the electrostatic precipitator, especially at small angles α. In the embodiment illustrated, the upper cam control elements 11*a,* 11*b* extend horizontally through a plurality of rows in the transverse direction of the electrostatic precipitator.

In the embodiment illustrated, the lower ends of the collecting electrodes 2 are for each row loosely controlled in the longitudinal as well as transverse direction of the electrostatic precipitator by means of lower control elements, which will appear from the following description.

As shown in FIGS. 1 and 2, the lower ends of the collecting electrodes are inserted between a pair of rods in the form of flat iron rods 12*a,* 12*b* horizontally oriented in the longitudinal direction. In this manner, the flat iron rods prevent the motion of the collecting electrodes 2 in the transverse direction of the electrostatic precipitator. The control of the collecting electrodes 2 in the longitudinal direction of the electrostatic precipitator is carried out by means of spacer members 13 arranged before, after and between the collecting electrodes 2. The spacer members 13 are fixedly mounted in the transverse direction across the rods 12*a,* 12*b* as shown in FIG. 3. Moreover, the row 1 of collecting electrodes is controlled in the transverse direction of the electrostatic precipitator by means of lower cam control elements 14*a,* 14*b* which are vertically oriented in the transverse direction and arranged at the ends of said pairs of rods. The rods 12*a,* 12*b* are further provided with a supporting suspension 15 in the centre of the row 1. The control described above is designed with regard to thermal expansion. The distance between the pair of rods is fixed by spacer members (not shown), which in suitable positions are arranged between the rods.

The invention is, of course, not restricted to the embodiments described above and can be modified in various ways within the scope of the appended claims.

For instance, the lower ends of the collecting electrodes 2 can be firmly controlled instead of loosely controlled.

For instance, the anvil 9 can be designed so as to extend across at least two successive parallel rows 1 of collecting electrodes 2 in the transverse direction of the electrostatic precipitator, instead of across a single row.

I claim:

1. A device in an electrostatic precipitator for the suspending, guiding and rapping of one or more collecting electrodes arranged substantially vertically in one or more substantially parallel rows, the device comprising:

a substantially horizontally oriented supporting element to which upper ends of collecting electrodes of a row of collecting electrodes are attached;

at least one connecting element connecting the supporting element to the casing of the electrostatic precipitator;

a guiding device for guiding motion of the row of collecting electrodes in at least one of a transverse and a longitudinal direction of the electrostatic precipitator; and a rapping mechanism for rapping the collecting electrodes, the rapping mechanism including a device for rapping and an anvil connected to the supporting element;

the supporting element being separately suspended by the at least one connecting element, the at least one connecting element being movably fastened and formed as at least one elongated rod, each of the at least one rod defining an angle relative to a vertical axis lying within a range of 5°35°, thereby enabling, a limited, minimal, horizontal pivoting motion of the row of collecting electrodes in the longitudinal direction of the electrostatic precipitator during rapping.

2. The device as claimed in claim 1, wherein the at least one connecting element includes two elongate rods, each of the two rods defining an angle lying within a range of 5–15°, and arranged such that the rods are positioned substantially in a plane of the row of connecting electrodes such that a distance between lower ends of the two rods is smaller than a distance between upper ends of the two rods.

3. The device as claimed in claim 2, wherein the anvil is fixedly mounted on an upper side of the supporting element and includes a rapping shoulder forming a rapping point of the rapping device, the shoulder being arranged such that the rapping point is located above a horizontal center line of the supporting element.

4. The device as claimed in claim 2, wherein the anvil extends across at least two rows of collecting electrodes in the transverse direction of the electrostatic precipitator and is fixedly mounted on an upper side of the supporting element of each row.

5. The device as claimed in claim 2, wherein the guiding device includes at least lower guiding elements cooperating with lower ends of the collecting electrodes.

6. The device as claimed in claim 5, wherein the lower ends of the collecting electrodes are guided by the lower guiding elements in the transverse as well as the longitudinal direction of the electrostatic precipitator by longitudinally oriented, horizontal bars, to which the lower ends of the collecting electrodes are attached.

7. The device as claimed in claim 6, wherein the row of collecting electrodes is guided in the transverse direction of the electrostatic precipitator by transversely oriented lower cam guiding elements arranged at the ends of the bars.

8. The device as claimed in claim 2, wherein the guiding device includes at least upper guiding elements cooperating with the supporting element.

9. The device as claimed in claim 8, wherein the upper guiding elements include upper cam guiding elements cooperating with end portions of the supporting element, the cam guiding elements extending substantially horizontally in the transverse direction of the electrostatic precipitator.

10. The device as claimed in claim 9, wherein the guiding device includes lower guiding elements cooperating with lower ends of the collecting electrodes, the lower ends of the collecting electrodes being guided by the lower guiding elements in the transverse direction of the electrostatic precipitator by a longitudinally oriented, horizontal pair of bars between which the lower ends of the collecting electrodes are arranged and in the longitudinal direction of the electrostatic precipitator by spacer members arranged at least one of before, after, and between the collecting electrodes.

11. The device as claimed in claim 9, wherein the anvil is fixedly mounted on an upper side of the supporting element and includes a rapping shoulder forming a rapping point of the rapping device, the shoulder being arranged such that the rapping point is located above a horizontal center line of the supporting element.

12. The device as claimed in claim 8, wherein the guiding device includes lower guiding elements cooperating with lower ends of the collecting electrodes,. the lower ends of the collecting electrodes being guided by the lower guiding elements in the transverse direction of the electrostatic precipitator by a longitudinally oriented, horizontal pair of bars between which the lower ends of the collecting electrodes are arranged and in the longitudinal direction of the electrostatic precipitator by spacer members arranged at least one of before, after, and between the collecting electrodes.

13. The device as claimed in claim 12, wherein the lower ends of the collecting electrodes are guided by the lower guiding elements in the transverse as well as the longitudinal direction of the electrostatic precipitator by longitudinally oriented, horizontal bars, to which the lower ends of the collecting electrodes are attached.

14. The device as claimed in claim 13, wherein the row of collecting electrodes is guided in the transverse direction of the electrostatic precipitator by transversely oriented lower cam guiding elements arranged at ends of the bars.

15. The device as claimed in claim 12, wherein the row of collecting electrodes is guided in the transverse direction of the electrostatic precipitator by transversely oriented lower cam guiding elements arranged at the ends of the bars.

16. The device as claimed in claim 8, wherein the anvil is fixedly mounted on an upper side of the supporting element and includes a rapping shoulder forming a rapping point of the rapping device, the shoulder being arranged such that the rapping point is located above a horizontal center line of the supporting element.

17. The device as claimed in claim 8, wherein the anvil extends across at least two rows of collecting electrodes in the transverse direction of the electrostatic precipitator and is fixedly mounted on an upper side of the supporting element of each row.

18. The device as claimed in claim 1, wherein the anvil is fixedly mounted on an upper side of the supporting element and includes a rapping shoulder forming a rapping point of the rapping device, the shoulder being arranged such that the rapping point is located above a horizontal center line of the supporting element.

19. The device as claimed in claim 18, wherein the rapping device operates in a vertical plane around a rotary shaft extending substantially horizontally in the transverse direction of the electrostatic precipitator, the rapping device giving the anvil a horizontally directed rap during rapping.

20. The device as claimed in claim 1, wherein the anvil extends across at least two rows of collecting electrodes in the transverse direction of the electrostatic precipitator and is fixedly mounted on an upper side of the supporting element of each row.

21. The device as claimed in claim 20, wherein the rapping device operates in a vertical plane around a rotary shaft extending substantially horizontally in the transverse direction of the electrostatic precipitator, the rapping device giving the anvil a horizontally directed rap during rapping.

* * * * *